United States Patent [19]

Sieberth

[11] Patent Number: 4,821,429

[45] Date of Patent: Apr. 18, 1989

[54] AIR GUIDE BOX FOR STABILIZING THE RUN OF A WEB, FOR INSTANCE A PAPER WEB

[75] Inventor: Ralf Sieberth, Appleton, Wis.

[73] Assignee: J. M. Voith, GmbH, Heidenheim, Fed. Rep. of Germany

[21] Appl. No.: 126,863

[22] Filed: Nov. 30, 1987

[51] Int. Cl.[4] ..... F26B 5/00

[52] U.S. Cl. ..... 34/114; 34/116; 34/155

[58] Field of Search ..... 34/151, 155, 156, 160, 34/114, 116, 122, 123

[56] References Cited

U.S. PATENT DOCUMENTS

| | | | |
|---|---|---|---|
| 3,587,177 | 6/1971 | Overly | 34/156 |
| 4,441,263 | 4/1984 | Vedenpaa | 34/115 |
| 4,502,231 | 3/1985 | Fissmann et al. | 34/114 |
| 4,539,762 | 9/1985 | Eskelinen et al. | 34/114 |
| 4,551,203 | 10/1985 | Eskelinen | 34/114 X |
| 4,628,618 | 12/1986 | Virta et al. | 34/116 |
| 4,669,198 | 6/1987 | Wedel | 34/116 X |
| 4,686,777 | 8/1987 | Cooke | 34/116 |

*Primary Examiner*—Steven E. Warner

*Attorney, Agent, or Firm*—Albert L. Jeffers; Richard L. Robinson

[57] ABSTRACT

Taught is an air guide box for stabilizing the run of a web, for instance a paper web, specifically for the drying section of a paper machine. The air guide box is connected to a blowing air supply and extends transverse to the running direction of the paper web. The paper web proceeds, preferably together with a backing belt, from one drying cylinder to another drying cylinder. A first wall of the air guide box, viewed in cross section, extends along the paper web or the backing belt forming a first gap therewith. A second wall extends along the cylinder surface of the first drying cylinder. Provided in the first wall is an opening which extends across the length of the air guide box and serves to remove the air from the first gap into the interior of the air guide box. Said opening is connected with an intake line of the blowing air supply.

14 Claims, 3 Drawing Sheets

AIR GUIDE BOX FOR STABILIZING THE RUN OF A WEB, FOR INSTANCE A PAPER WEB

The present invention concerns an air guide box which is connected to a blowing air supply, serves to stabilize the run of a web, for instance a paper web, and is intended specifically for the drying section of a paper machine.

In particular, the web, preferably together with a backing belt, runs from a roll or drying cylinder to another roll or drying cylinder and the air guide box is arranged transverse to the web.

An air guide box of the categorial type is known from the German patent document No. 32 36 576 (=U.S. Pat. No. 4,502,231).

The stability of the run of the paper web (with or without a backing belt) constitutes on paper machines, at increasing machine speeds, a bottleneck. Forces of various types act on the paper web, causing during its passage through the drying section, as the speed increases, phenomena such as web flutter or wrinkling. Similar phenomena occur also on high-speed machines for converting paper or plastic webs. These phenomena, which may even lead to web break, are to be avoided as much as possible.

This objective was extensively achieved with the air guide box according to the German patent document No. 32 36 576. However, specific examinations of the air flows, for one, and practical experience, for another, have shown that the air guide box can be optimized further as regards the requirements imposed on it. Desired, e.g., is a further reduction of the blowing air demand.

Another problem is the air removing device which heretofore was provided on the approach end of the air guide box. A mechanical air removing device in contact with a backing belt is inevitably subject to wear. Also given is the risk that the seams of the backing belt (drying wire) will wear. When using a so-called air knife or an arrangement according to the U.S. Pat. No. 4,628,618, the blowing air demand will increase along with the power of the blower. As mentioned above, however, exactly the opposite is desired.

The problem underlying the present invention consists in modifying the prior air guide box design so that the above risk of wear will be eliminated while the amount of air supplied externally can nonetheless be reduced further. This problem is solved by the means set forth in the claims Further developments of the air guide box are also set forth in the claims The inventional air guide box forms with regard to the blowing air supply a more or less self-contained system. Due to the fact that the blowing air required for generating a vacuum on the running web is to a maximum extent recycled to the blowing air supply, the air amount to be supplied externally is being reduced considerably.

The invention will be more fully explained hereafter with the aid of the drawings.

Figure 1:
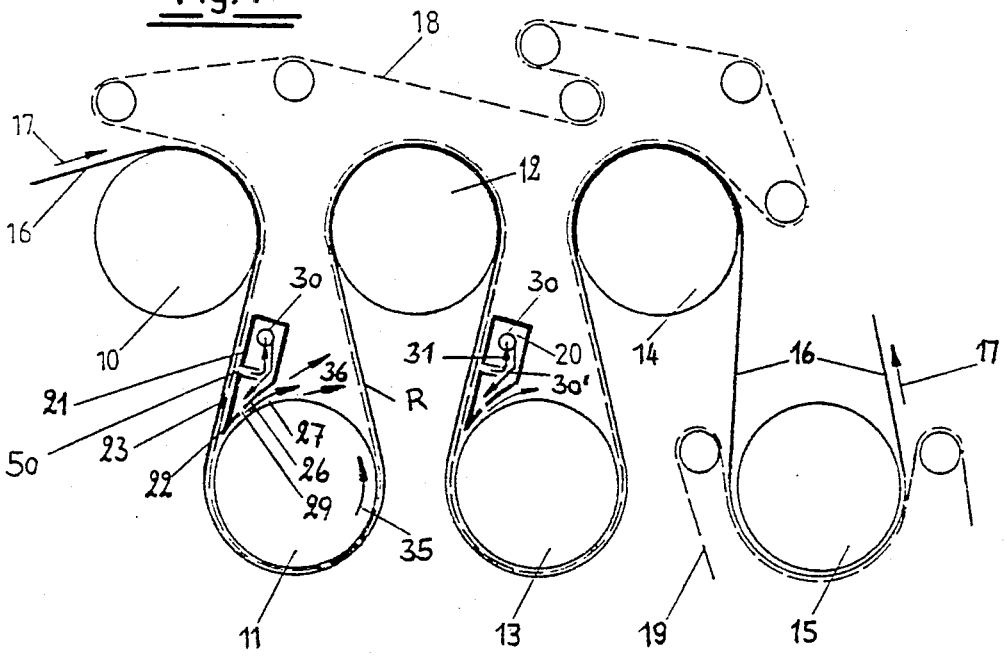
Figure 6:
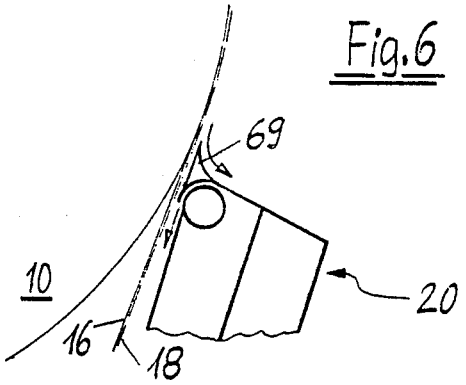

FIG. 1 shows a schematic section of a paper machine drying section;

FIGS. 2–5, four different embodiments of an inventional air guide box in cross section and scaled up relative to FIG. 1;

FIG. 6, a possibility of modifying the approach edge of the air guide box.

The section of a dryer part as illustrated in FIG. 1 operates by the principle of the so-called contact felt backing; i.e., a single backing belt accompanies the paper web meandering around the upper and lower drying cylinders. But this does not represent a restriction of the applicational scope of the inventional air guide box; it can be used also in connection with the socalled double wire backing, where the paper web runs freely between the drying cylinders but is forced onto the upper drying cylinders by an upper drying wire and upon the lower drying cylinders by a lower drying wire. The inventional air guide box can conceivably be used also on high-speed paper converting machines, for instance on coaters.

The five drying cylinders 10 through 14 illustrated in FIG. 1 form a drying group of a dryer section. Another drying cylinder, marked 15, is part of a subsequent drying group. The drying cylinders 10, 12 and 14 are arranged in a top row, whereas the cylinders 11, 13 and 15 are arranged in a bottom row. The paper web 16 to be dried meanders in the direction of arrows 17 across the drying cylinders. In the process, it is accompanied within the first drying group 10 through 14 continuously by an endless backing belt (drying wire) 18 which is permeable to air. The drying cylinders 10, 12 and 14 of the upper row are located outside the loop formed by the backing belt 18, whereas the cylinders 11 and 13 of the bottom row are located inside. Thus, the paper web 16 runs in the area of the upper cylinders 10, 12 and 14 between their cylinder surface and the backing belt 18. In the area of the bottom cylinders 11 and 13, in contrast, the paper web 16 is on the outside of the backing belt 18 which is in contact with these cylinders. Along the free sections between the cylinders 12 through 14, the paper web 16 is suppported by the backing belt 18. A free paper train exists for the first time between the cylinders 14 and 15. In subsequent drying groups, each cylinder row has a backing belt 19 of its own.

Along the joint path of the paper web 16 and the backing belt 18, from a top drying cylinder 10 respectively 12 to a lower drying cylinder 11 respectively 13, an air guide box 20 each is provided on the side of the backing belt 18. Rigid in design, each of these air guide boxes 20 extends crosswise through the drying section, preferably across the entire machine width. But is is also possible for an air guide box of reduced length to extend only across a marginal area of the paper web.

The backing belt 18 forms together with the lower drying cylinders 11, 13 a first inlet gore 22. Essentially closed all around, the air guide box 20 features a first wall 21 which, viewed in cross section, extends along the backing belt 18 toward the inlet gore 22. Resulting between the first wall 21 and the backing belt 18 is a first gap 23 whose clearance, according to the embodiment known from the German patent document 32 36 576, increases toward the inlet gore 22.

Additionally, the air guide box 20 has a second wall 26 which, while forming a second gap 27, is situated opposite the cylinder surface of the respective lower drying cylinder 11 respectively 13. The first wall 21 and the second wall 26 may form a common point which extends deep into the inlet gore, or they are connected with each other by way of a third wall 40 (FIG. 2) which is arranged approximately perpendicularly to the plane of the backing belt 18. Conceivable is also a curved design of the transition from the first wall 21 to the second wall 26.

Figure 2:
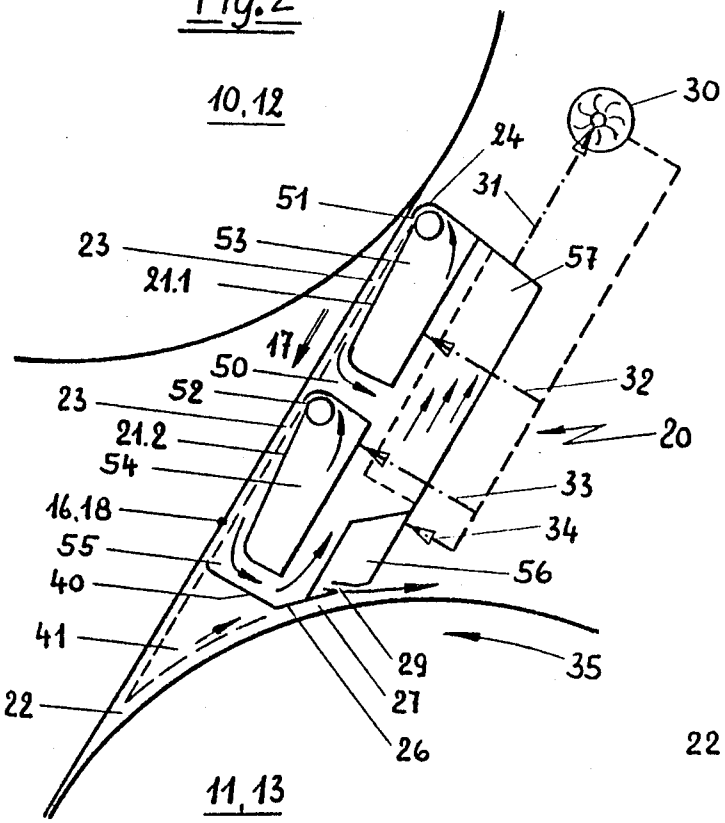

Since the inlet gore 22 is in the latter two embodiments occupied only insufficiently and, therefore, leakage air might penetrate sideways into the first and second gap 21 respectively 27, the air guide box according to the inventional type illustrated in FIG. 2 is defined respectively sealed off on both ends through air barriers 41. These are adapted to the shape of the inlet gore 22.

To impede the entrainment of air into the inlet gore 22 by the lower drying cylinder 11 respectively 13, or to avoid it, the second wall 26 is provided with a blow opening 29, discharging blowing air opposite to the direction of rotation (arrow 35) of the lower drying cylinder 11 respectively 13. This blow opening 29 extends transverse to the drying section in the longitudinal direction of the air guide box 20; additionally it is so arranged that it extends at an acute angle to the second wall 26, thus discharging blowing air approximately tangentially to the cylinder surface of the lower drying cylinder 11 respectively 13. This blowing air forms thus a baffle for the air layer carried along by the drying cylinder 11 respectively 13, preventing it from penetrating into the inlet gore 22. But the present invention is not limited to this embodiment with the blow opening 29 in the second wall 26.

As mentioned before, the air guide box 20 is essentially closed all around. Blowing air is injected in the air guide box 20 through a blowing air supply 30 which is connected to one box end.

The basic idea of the present invention is to design the air guide box 20 including the blowing air supply 30 as much as possible as a self-contained system, that is, recycling the air discharging from the first gap 23 (and according to a further development of the invention also from the second gap 27) back to the blowing air supply 30. Accomplished thereby is, among other things, that less air than previously needs to be supplied externally to the space defined by the three cylinders (e.g., 10, 11 and 12) and the paper web 16; this precludes a buildup of a pressure in this space (also called a "pocket").

The basic idea of the invention is schematically indicated in FIG. 1 insofar as in the first wall 21 there is indicated a withdrawal opening 50 which is connected with the intake line 31 of the blowing air supply 30 which, in turn, delivers blowing air to the air guide box through a pressure line 30'.

Illustrated in FIGS. 2 though 5 are always an upper drying cylinder 10, 12 and a lower drying cylinder 11, 13. The paper web 16 and the backing belt 18 run from the upper drying cylinder 10, 12 to the lower drying cylinder 11, 13.

Arranged essentially parallel with the tangential plane, between the upper and lower drying cylinders 10/12 respectively 11/13, is the air guide box 20, and at that, on the side of the backing belt 18 (refer to FIG. 1). Located between the air guide box 20 and the paper web 16 with the backing belt 18 is the first gap 23, between the air guide box and the lower drying cylinder 11 respectively 13, the second gap 27. The first wall 21 defining the first gap 23, and the second wall 26 of the air guide box 20 defining the second gap 27 are connected with each other through a third wall 40 with an approximately perpendicular orientation to the paper web 16 or the backing belt 18, respectively.

For the lateral definition of the inlet gore 22 there is provided, in the area between this third wall 40 and the lowest point of the inlet gore 22 on both ends of the air guide box 20, an air barrier 41 each, which in the drawing is indicated only by broken lines.

Provided in the second wall 26 is a blow opening 29 which relative to the second wall 26 is arranged at an acute angle and blows approximately tangentially at the cylinder surface of the lower drying cylinder 11 respectively 13.

Formed by two partial walls 21.1 and 21.2, the design of the first wall is such that a vacuum occurs in the first gap 23 ("foil effect") causing the paper web 16 to safely cling to the backing belt 18. Should the paper web run without a backing belt from cylinder to cylinder, along the air guide box, the latter ensures a safe support of the paper web slightly spaced from the first wall 21.1 and 21.2. To achieve these objectives, each partial wall 21.1 and 21.2 diverges in customary fashion from the running direction of the backing belt 18 or the paper web, respectively; provided additionally, between the two partial walls 21.1 and 21.2, is inventionally a removal opening 50 which extends across the length of the air guide box 20 and permits air to proceed from the first gap 23 into the interior of the air guide box 20. This removal opening 50 connects via an air collection box 57 with an intake line 31 of the blowing air supply 30—which schematically is illustrated as a fan—so that the withdrawn air is recycled to the air circulation. At this juncture it is pointed out that the mechanical air removing device provided on the approach edge of the air guide box according to the German patent document No. 32 36 576 is not needed according to the prsent invention. But it may be suitable to provide instead of the known air removing device according to FIG. 6 a so-called boundary layer splitter. It may be fashioned, e.g., as a slat with approximately triangular cross section extending at a certain spacing from the backing belt 18 across the length of the air guide box. The spacing of the blade type approach edge of this slat from the backing belt 18 is so adjusted that part of the boundary air layer carried by the backing belt will be removed from it by the "boundary layer splitter", so that then only the remainder of the boundary air layer will be carried into the gap 23.

The description given so far applies to all four embodiments according to FIGS. 2 through 5. These different examples will be explained hereafter in detail and with regard to their specific characteristics.

FIG. 2 shows a first example where on the approach edge 24 of the first wall (21.1 and 21.2) there is a blowing slot 51 provided; a second similar blowing slot 52 is provided on the second edge (in the web running direction 17) of the removal opening 50. The air space is thus divided in the first gap 23, and at that, in a first part between the approach edge 24 and the removal opening 50 and a second part between the removal opening and the third wall 40. The parts of the first wall are formed each by partial walls 21.1 respectively 21.2 of air boxes 53, 54 which are connected with pressure lines 32, 33 of the blowing air supply 30 and inject the air through blowing slots 51, 52 into the first gap 23.

The blowing slots 51, 52 extend in the longitudinal direction of the air guide box 20, that is, transverse to the web width. They blow air in the running direction 17 of the backing belt 18 respectively paper web 16 into the gap 23. Since the blowing direction and the web running direction correspond, the air pressure required in the blowing slots (and thus the fan power) is very low. The said partial walls 21.1, 21.2 of the air boxes 53, 54 diverge from the backing belt 18 in its running direction.

The air carried within the gap 23 along the bottom air box 54 by the backing belt 18 is removed into the interior of the air guide box 20 through a second removal opening 55 which is contained between this second air box 54 and the third wall 40. This second removal opening 55 is connected as well with the intake line 31 of the blowing air supply 30. Thus, the air injected through the air boxes 53, 54 and the blowing slots 51, 52 into the gap 23 is recycled to the blowing air supply 30.

A third pressure line 34 of the blowing air supply 30 runs to a third air box 56 for feeding air to the prviously mentioned blow opening 29 which is arranged in the second wall 26 of the air guide box 20.

Figure 3:
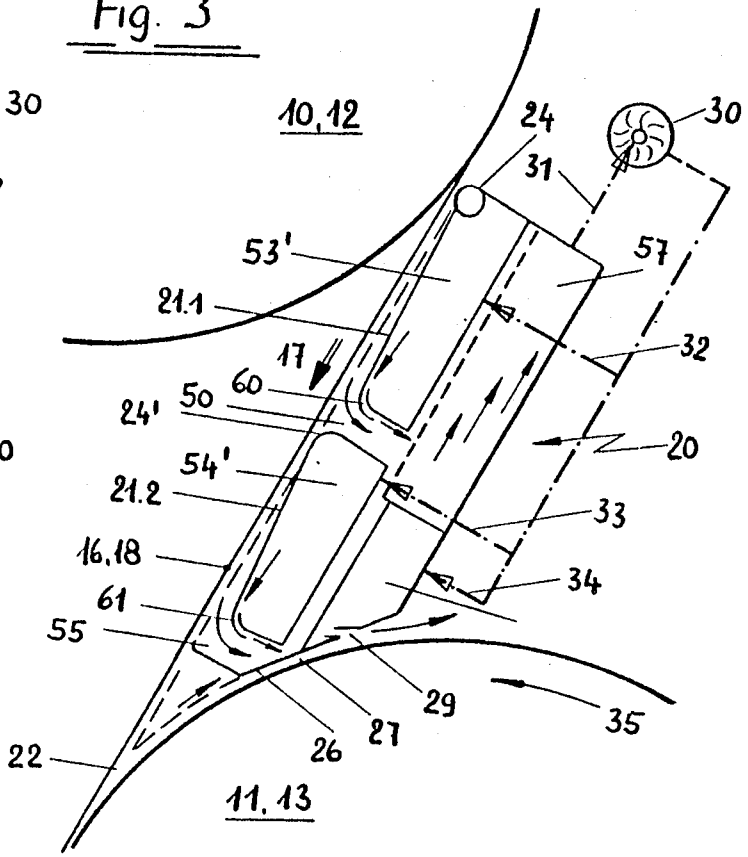

In the embodiment according to FIG. 3, the blowing slots 51 and 52 illustrated in FIG. 2 are absent. Instead, each of the air boxes 53', 54' has on its bottom end on the drawing a blowing slot 60, 61 which, approximately perpendicular to the running direction 17, is directed at the box interior. Blowing air is discharged in the form of a driving jet into the respective removal opening 50, 55 through these blowing slots 60, 61. Due to the suction generated thereby, the air is removed from the first gap 23 and is passed to the blowing air supply 30 through the intake line 31 connected to the air collection box 57.

Figure 4:
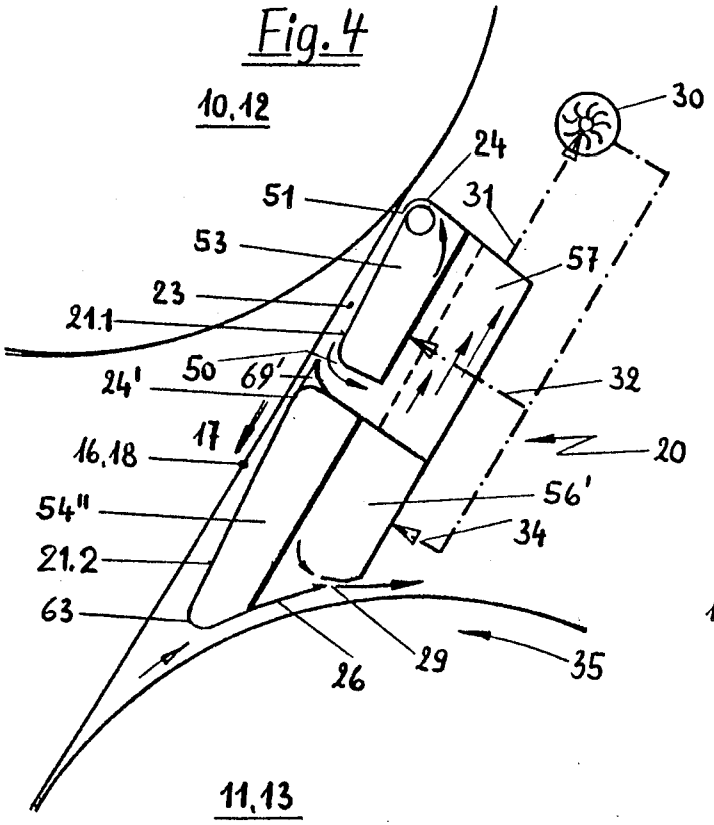

In the embodiment according to FIG. 4, the air box 53 on the approach side is designed analogous to FIG. 2 with a blowing slot 51. Again, air from the gap 23 is removed through the first removal opening 50 and returned to the blowing air supply 30.

The second air box 54", viewed in running direction, is closed all around and, thus, does not have a blowing slot. Its effect is based solely on its wall 21.2 diverging from the backing belt 18. The approach edge 24' of the second air box 54" may be rounded or designed as a boundary layer splitter 69' according to FIG. 6. The wall 21.2 extends via a circular arch 63 into the second wall 26.

Figure 5:
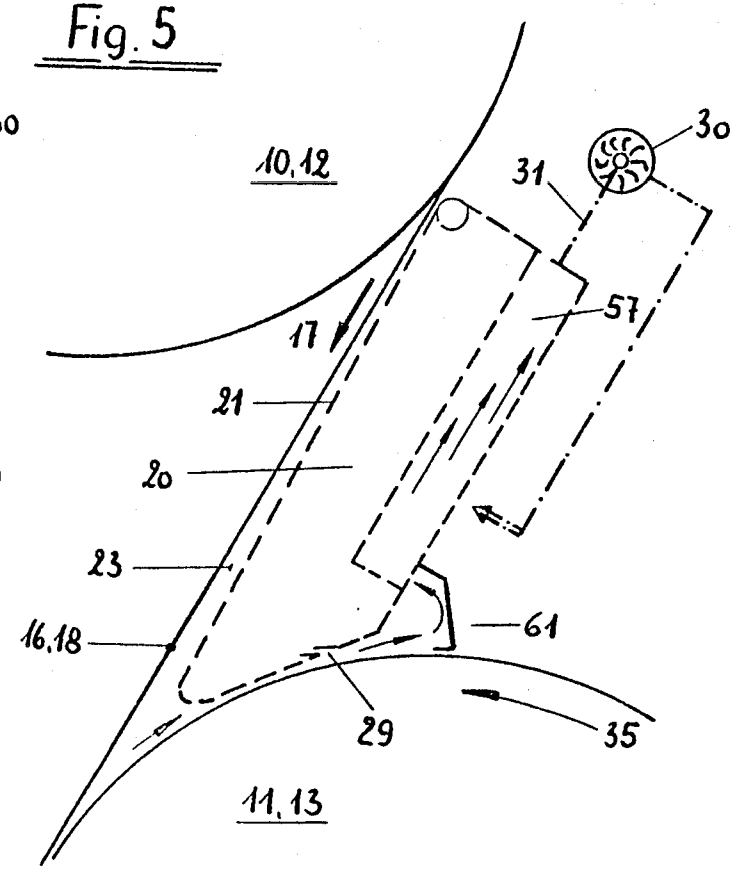

The diagram according to FIG. 5 shows an air guide box 20 which may be designed according to the embodiments relative to FIGS. 2 through 4. A further development of these design variants provides for collecting the blocking air discharging from the blow opening 29 by means of a baffle 61; this baffle extends across the entire length of the air guide box 20 and passes the blocked air to the air collection box 57. The air balance (energy balance) of the blowing air supply is further improved thereby, precluding the risk that the air discharging from the blow opening 29 will lift the upward travelling paper train (R in FIG. 1) from the backing belt 18.

The shape and dimensions of the air guide box, naturally, are not limited to the drawing illustration. It is quite conceivable to extend the air guide box so far upward that its top end 24 will be situated at or above the departure point of the paper web from the upper cylinder 10, 12.

Besides, it is conceivable to arrange the fan 30 not outside but inside the air guide box. In this case, several small fans arranged across the length of the air guide box may as well be provided. When arranging these fans, e.g., directly behind the removal opening 50, the kinetic energy of the air influx can be utilized for reduction of the fan power.

I claim:

1. An air guide box connected to a blowing air supply, for stabilizing the run of a web, for instance a paper web, specifically for the drying section of a paper machine where the web runs from a first roll or drying cylinder onto a second roll or drying cylinder having a cylinder surface and where the air guide box is arranged transverse to the web and has the following characteristics:

a first wall, viewed in cross section, extends along the web , forming a first gap therewith, a second wall, extends along the cylinder surface of the second roll or drying cylinder forming a second gap therewith, characterized in that in the first wall there is provided a removal opening extending across the length of the air guide box and serving to remove the air from the first gap into the interior of the air guide box , in that the removal opening is connected with an intake line of the blowing air supply , and in that in the first wall there is provided at least one blowing slot which is connected with a pressure line of the blowing air supply and which, relative to the running direction of the web, is arranged before the removal opening, the blowing slot having a blowing direction coinciding essentially with the web running direction.

2. Air guide box according to claim 1, characterized in that the clearance of the first gap increases in the web running direction.

3. Air guide box according to claim 1, characterized in that it is limited on its ends by air barriers walls which are directed against the web and extend in the running direction of the latter up into an entrance gore between the web and the second cylinder.

4. Air guide box according to claim 1, characterized in that a second blow opening is provided in the second wall for discharging blowing air into the second gap, the blowing direction of which opening extends at an acute angle to the second wall opposite to the running direction of the second drying cylinder.

5. Air guide box according to claim 4, characterized in that the second blow opening is preceded by a baffle which blocks the discharged blowing air and returns it through the intake line to the blowing air supply.

6. Air guide box according to claim 1, characterized in that on its approach side edge spaced from the running web there is provided a slat which divides the approaching air boundary layer and deflects the upper part of the layer.

7. Air guide box according to claim 6, characterized in that a boundary layer splitter is arranged on the approach side edge of a second air box.

8. An air guide box connected to a blowing air supply, for stabilizing the run of a web, for instance a paper web, specifically for the drying section of a paper machine where the web runs from a first roll or drying cylinder onto a second roll or drying cylinder having a cylinder surface and where the air guide box is arranged transverse to the web and has the following characteristics:

a first wall, viewed in cross section, extends along the web, forming a first gap therewith, a second wall, extends along the cylinder surface of the second roll or drying cylinder, forming a second gap therewith, characterized in that in the first wall there is provided a removal opening extending across the length of the air guide box and serving to remove the air from the first gap into the interior of the air guide box, in that the removal opening is connected with an intake line of the blowing air supply, and in that in the first wall there is provided at least one blowing slot which is connected with a pressure line of the blowing air supply , empties into the removal opening and whose blowing direction is into the interior of the air guide box, approximately perpendicular to the web running direction.

9. An air guide box connected to a blowing air supply, for stabilizing the run of a web, for instance a paper web, specifically for the drying section of a paper machine where the web runs from a first roll or drying cylinder onto a second roll or drying cylinder having a cylinder surface and where the air guide box is arranged transverse to the web and has the following characteristics:

a first wall, viewed in cross section, extends along the web, forming a first gap therewith, a second wall, extends along the cylinder surface of the second roll or drying cylinder, forming a second gap therewith, characterized in that in the first wall there is provided a removal opening extending across the length of the air guide box and serving to remove the air from the first gap into the interior of the air gudie box, in that the removal opening is connected with an intake line of the blowing air supply, and in that the air guide box is a self-contained device with at least two air boxes connected to pressure lines of the blowing air supply and with an air collection box connected to an intake line of the blowing air supply with the blowing air discharged from the air boxes being at least partly returned to the blowing air supply through the removal openings.

10. Air guide box according to claim 9, characterized in that, viewed in the web running direction there is provided an air box with a blowing slot on the approach side and, next to the removal opening a second air box which is closed all around.

11. Air guide box according to claim 9, characterized in that, viewed in the running direction, there are provided two air boxes with, viewed in the running direction, an adjacent removal opening each.

12. Air guide box according to claim 11, characterized in that the two air boxes each feature on the approach side a blowing slot which blows in the web running direction.

13. Air guide box according to claim 11, characterized in that the two air boxes each feature on the departure side a blowing slot which, perpendicular to the web running direction, is directed into the box interior.

14. Air guide box according to claim 11, characterized in that a boundary layer splitter is arranged on the approach side edge of a second air box.

* * * * *